US007832556B2

(12) United States Patent
Ghini et al.

(10) Patent No.: US 7,832,556 B2
(45) Date of Patent: Nov. 16, 2010

(54) PACKAGE FOR SMALL GROUPS OF TOBACCO ARTICLES

(75) Inventors: Marco Ghini, Monte San Pietro (IT); Luca Petrucci, Castelfranco Emilia (IT); Stefano Negrini, Calderara Di Reno (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 12/091,255

(22) PCT Filed: Oct. 27, 2006

(86) PCT No.: PCT/IB2006/003021

§ 371 (c)(1),
(2), (4) Date: Oct. 14, 2008

(87) PCT Pub. No.: WO2007/049138

PCT Pub. Date: May 3, 2007

(65) Prior Publication Data

US 2009/0242434 A1 Oct. 1, 2009

(30) Foreign Application Priority Data

Oct. 28, 2005 (IT) ..... B02005A0660

(51) Int. Cl.
*A24F 15/00* (2006.01)
*B65D 85/10* (2006.01)

(52) U.S. Cl. ..... 206/268; 206/256; 206/271; 206/273

(58) Field of Classification Search ..... 206/256, 206/268, 265, 271, 273, 821, 264; 229/160.1
See application file for complete search history.

(56) References Cited

U.S. PATENT DOCUMENTS

| | | | | |
|---|---|---|---|---|
| 3,752,307 A | | 8/1973 | German | |
| 4,850,482 A | * | 7/1989 | Campbell | 206/273 |
| 5,150,720 A | * | 9/1992 | Focke et al. | 131/329 |
| 5,158,664 A | * | 10/1992 | Colgan et al. | 206/242 |

(Continued)

FOREIGN PATENT DOCUMENTS

AU 84062/75 2/1977

(Continued)

OTHER PUBLICATIONS

International Search Report in PCT/IB2006/003021 dated Mar. 26, 2007.

(Continued)

*Primary Examiner*—David T Fidei
(74) *Attorney, Agent, or Firm*—Marshall, Gerstein & Borun LLP

(57) ABSTRACT

A package for tobacco articles, having a group of tobacco articles, and a cup-shaped container which houses the group of tobacco articles and has an open top end, a bottom wall, two parallel, opposite major lateral walls, and two parallel, opposite minor lateral walls; at least one retaining member is located inside the container, projects perpendicularly from at least one of the lateral walls, defines a supporting surface for the group of tobacco articles, and is defined by two rigid panels separated from each other by a crease line and folded one towards the other.

17 Claims, 15 Drawing Sheets

U.S. PATENT DOCUMENTS

| | | | | | |
|---|---|---|---|---|---|
| 5,439,105 | A | * | 8/1995 | Focke | 206/268 |
| 5,480,025 | A | | 1/1996 | Draucker et al. | |
| 5,558,217 | A | * | 9/1996 | Focke et al. | 206/268 |
| 5,570,779 | A | * | 11/1996 | Draucker et al. | 206/246 |
| 5,584,389 | A | * | 12/1996 | Focke et al. | 206/256 |
| 5,819,925 | A | * | 10/1998 | Brizzi et al. | 206/268 |
| 2003/0034255 | A1 | * | 2/2003 | Luton et al. | 206/268 |
| 2006/0157357 | A1 | * | 7/2006 | Serafini et al. | 206/268 |

FOREIGN PATENT DOCUMENTS

| | | |
|---|---|---|
| DE | 3607311 | 1/1987 |
| DE | 198 55 574 | 6/2000 |
| GB | 522469 A | 6/1940 |

OTHER PUBLICATIONS

Chinese Office Action in Chinese Patent Application No. 200680040404.7 filed Jan. 22, 2010.

* cited by examiner

PACKAGE FOR SMALL GROUPS OF TOBACCO ARTICLES

CROSS-REFERENCE TO RELATED APPLICATIONS

This is the U.S. national phase application of International Application No. PCT/IB2006/003021, filed Oct. 27, 2006, which claims the benefit of Italian patent application No. BO2005A000660, filed Oct. 28, 2005.

TECHNICAL FIELD

The present invention relates to a package for tobacco articles.

In the following description, reference is made, for the sake of simplicity, to a rigid, hinged-lid packet of cigarettes purely by way of example.

BACKGROUND ART

Rigid, hinged-lid packets of cigarettes are currently the most commonly marketed, by being easy to produce, easy and practical to use, and by effectively protecting the cigarettes inside.

A rigid, hinged-lid packet of cigarettes comprises a group of cigarettes wrapped in a sheet of foil; and a rigid outer shell housing the group of cigarettes. The outer shell comprises a cup-shaped container housing the group of cigarettes and having an open top end; and a cup-shaped lid hinged to the container along a hinge to rotate, with respect to the container, between an open position and a closed position in which it opens and closes the open end respectively. A folded collar is normally connected to the inside of the container, and projects partly outwards of the open end to engage a corresponding inner surface of the lid when the lid is in the closed position.

Normally, the outer shell is substantially the same size as the group of cigarettes, so as to house the group of cigarettes firmly with no noticeable clearance. In some cases, however, the outer shell may be much larger than the group of cigarettes housed inside it, e.g. when image considerations call for an outer shell of "substantial" size, despite the small size of the groups of cigarettes; or to produce a packet of cigarettes containing fewer cigarettes using an existing standard-size blank; or to create an empty space inside the outer shell, in which to house an accessory (e.g. a lighter) or to use as an ashtray.

U.S. Pat. No. 5,819,925A1 describes a rigid, hinged-lid packet of cigarettes comprising a container, and a lid hinged to an open top end of the container. The container and the lid each comprise a front face, a rear face, and two side faces. A collar is fixed to the inside of and projects partly from the container, and comprises three consecutive portions having one or more slits defining respective tabs, which are hinged at their hinge sides to the collar and folded inwards of the container onto the group of cigarettes to form elastic damping elements to take up the slack produced between the container and the group of cigarettes by reducing the size of the group of cigarettes with respect to the predetermined size of the inside of the container.

U.S. Pat. No. 5,433,318A1 describes a rigid, hinged-lid packet of cigarettes having an insert for retaining small groups of cigarettes.

U.S. Pat. No. 5,150,720A1 describes a rigid, hinged-lid packet of cigarettes having a collar designed to form a filler to receive a shallow group of cigarettes.

Known rigid, hinged-lid cigarette packets for small groups of cigarettes, such as those described above, have the drawback of not being producible on standard packing machines for producing rigid, hinged-lid packets of cigarettes, and so requiring the design and construction of a special packing machine.

DISCLOSURE OF INVENTION

It is an object of the present invention to provide a package for tobacco articles, designed to eliminate the aforementioned drawbacks, and which at the same time is cheap and easy to produce.

According to the present invention, there is provided a package for tobacco articles, as claimed in the accompanying Claims.

BRIEF DESCRIPTION OF THE DRAWINGS

A number of non-limiting embodiments of the present invention will be described by way of example with reference to the accompanying drawings, in which:

FIG. 7 shows a rear view in perspective of the FIG. 15 packet in a closed configuration;

BEST MODE FOR CARRYING OUT THE INVENTION

Figure 3:
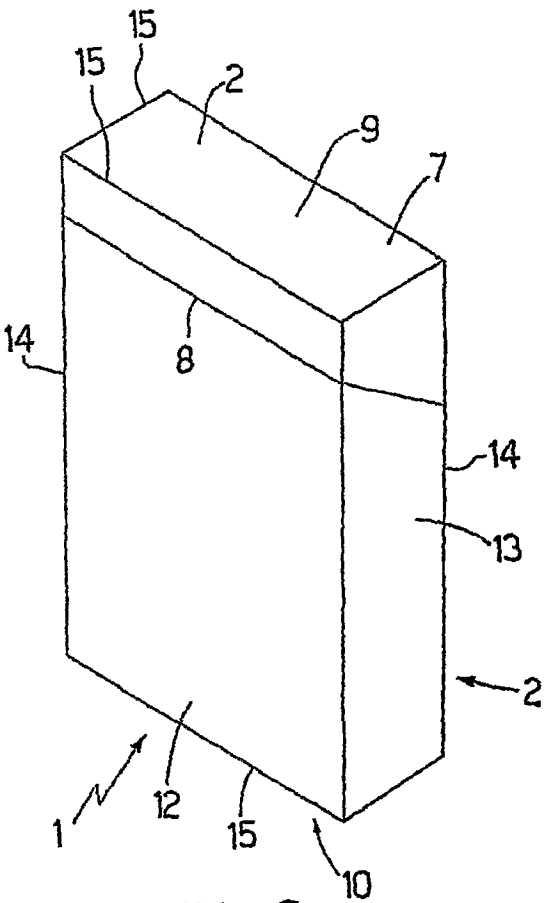
FIG. 3 shows a rear view in perspective of the FIG. 1 packet in a closed configuration.
Figure 2:
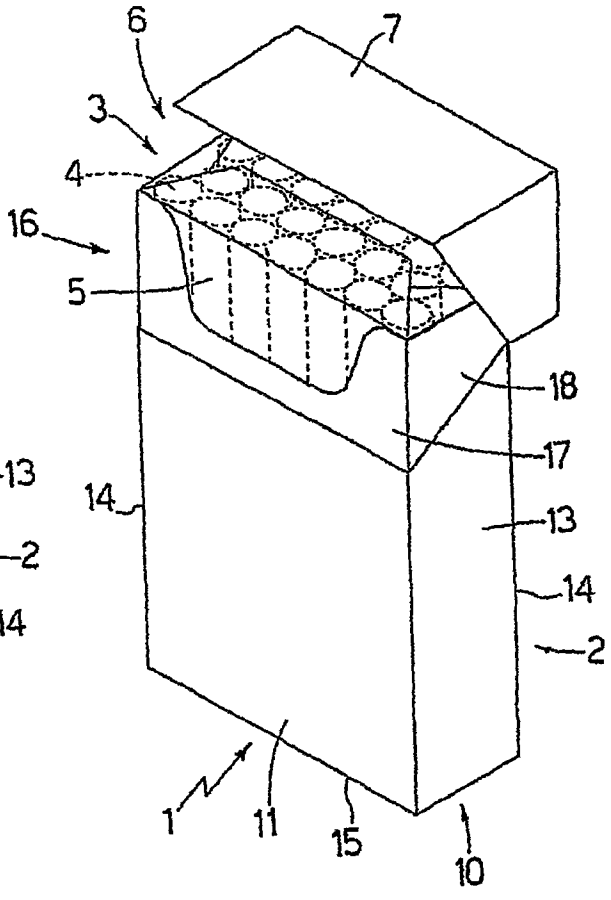
FIG. 2 shows a front view in perspective of the FIG. 1 packet in an open configuration.
Figure 1:
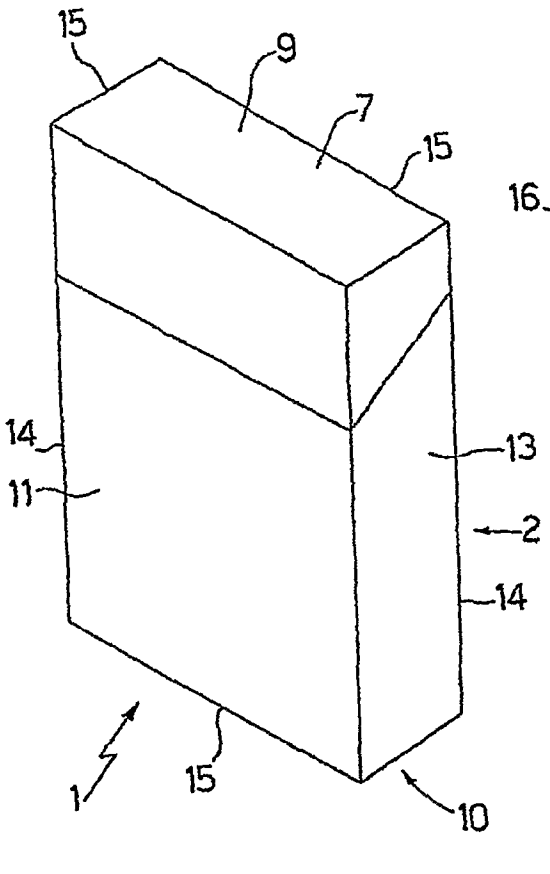
FIG. 1 shows a front view in perspective of a packet of cigarettes in accordance with the present invention and in a closed configuration.

Number 1 in FIG. 1 indicates as a whole a rigid packet of cigarettes comprising a cup-shaped container 2, and a group 3 of cigarettes 4 housed inside container 2. Group 3 of cigarettes 4 is parallelepiped-shaped, is wrapped in a sheet 5 of foil packing material, and is housed inside container 2. Container 2 has an open top end 6, and is provided with a cup-shaped lid 7 hinged to container 2 along a hinge 8 to rotate, with respect to container 2, between an open position (FIG. 2) and a closed position (FIGS. 1 and 3) respectively opening and closing open top end 6.

When lid 7 is in the closed position, container 2 is in the form of a rectangular parallelepiped comprising a top wall 9 and a bottom wall 10 parallel to and opposite each other; two parallel, opposite major lateral walls 11 and 12; and two parallel, opposite minor lateral walls 13. More specifically, one major lateral wall 11 defines a front wall 11 of container 2, and the other major lateral wall 12 defines a rear wall 12 of container 2. Four longitudinal edges 14 are defined between lateral walls 13 and front and rear walls 11 and 12; and eight transverse edges 15 are defined between top and bottom walls 9 and 10, front and rear walls 11 and 12, and lateral walls 13.

Packet 1 also comprises a collar 16, which is folded into a U and connected (glued) to the inside of container 2, and projects partly outwards of open top end 6 to engage a corresponding inner surface of lid 7 when lid 7 is in the closed position. Collar 16 comprises a front wall 17 positioned contacting front wall 11 of container 2; and two lateral walls 18 located on opposite sides of front wall 17 and positioned contacting minor lateral walls 13 of container 2.

Figure 5:
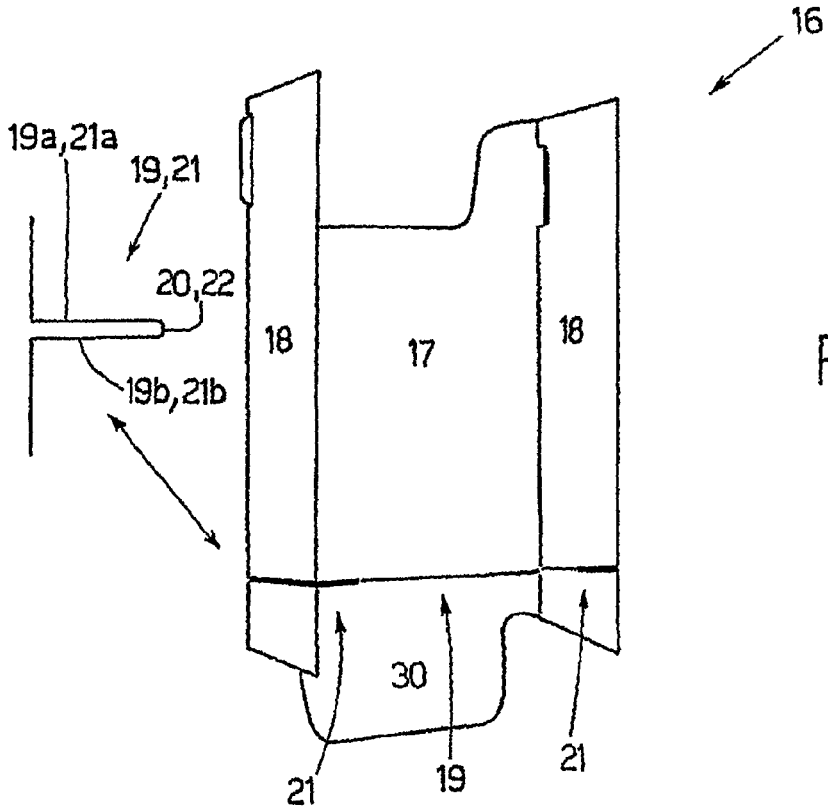
FIG. 5 shows a view in perspective of a collar of the FIG. 1 packet.

As shown in FIG. 5, packet 1 comprises a retaining member 19, which is located inside container 2, projects perpendicularly from front wall 11, defines a supporting surface for group 3 of cigarettes 4, and is defined by two rigid panels 19*a*, 19*b* separated by a crease line 20 and folded towards each other.

Packet 1 also comprises two retaining members 21, each of which is located inside container 2, projects perpendicularly from a respective lateral wall 13, defines a supporting surface for group 3 of cigarettes 4, and is defined by two rigid panels 21*a*, 21*b* separated by a crease line 22 and folded towards each other. Retaining members 19 and 21 define a bottom supporting surface parallel to bottom wall 11 to house inside container 2 a group 3 of cigarettes 4 smaller in height than walls 11 and 12 and lateral walls 13.

It is important to note that retaining members 19 and 21 form part of collar 16, and project perpendicularly from walls 11, 12 and lateral walls 13 when collar 16 is positioned inside container 2 with walls 17 and 18 of collar 16 directly contacting walls 11, 12 and 13 of container 2.

Figure 4:
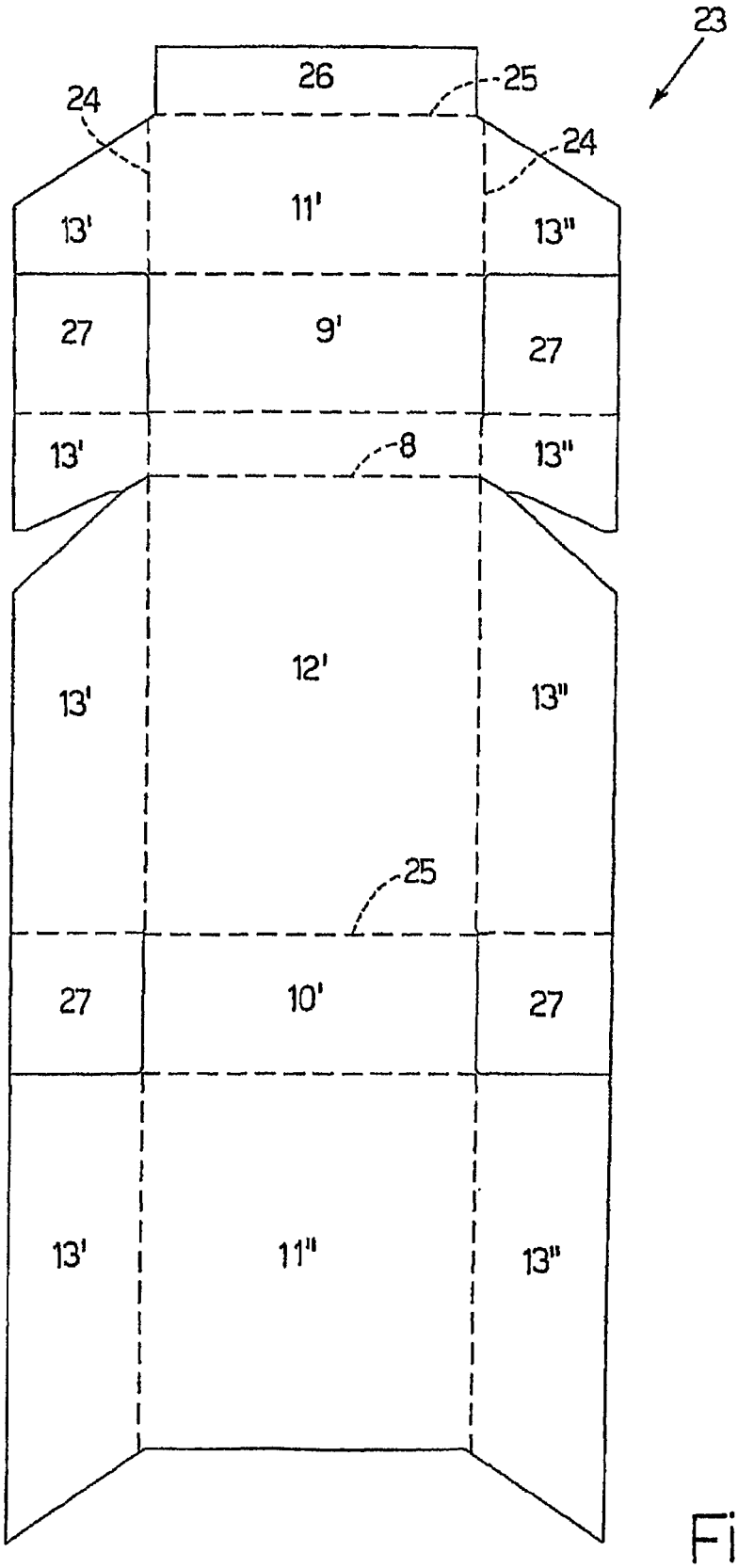
FIG. 4 shows a spread-out view of a blank by which to produce the FIG. 1 packet.

As shown in FIG. 4, container 2 is formed from a corresponding flat blank 23 substantially in the form of an elongated rectangle. In the following description, the parts of blank 23 are indicated, where possible, using the same reference numbers, with superscripts, as for the corresponding parts of container 2.

Blank 23 has two longitudinal crease lines 24, and a number of transverse crease lines 25 defining, between the two longitudinal crease lines 24, a panel 11' forming a top portion of front wall 11 (more specifically, the portion forming part of lid 7); a panel 9' forming top wall 9; a panel 12' forming rear wall 12; a panel 10' forming bottom wall 10; and a panel 11" forming a bottom portion of front wall 11 (more specifically, the portion forming part of container 2).

Panels 11', 11", 12' each have two lateral wings 13', 13" located on opposite sides of respective panel 11', 11", 12' and separated from respective panel 11', 11", 12' by longitudinal crease lines 24. Panel 11' has a reinforcing flap 26, and each wing 13', 13" of panel 12' has respective rectangular tabs 27 located at opposite ends of wing 13', 13".

When forming each packet 1, lateral wings 13', 13" are superimposed and glued to one another to define minor lateral walls 13 of container 2; and each tab 27 is folded squarely with respect to respective lateral wing 13', 13", and is superimposed on and glued to an inner surface of a respective panel 9', 10' to define an inner portion of a relative wall 9, 10.

Figure 6:
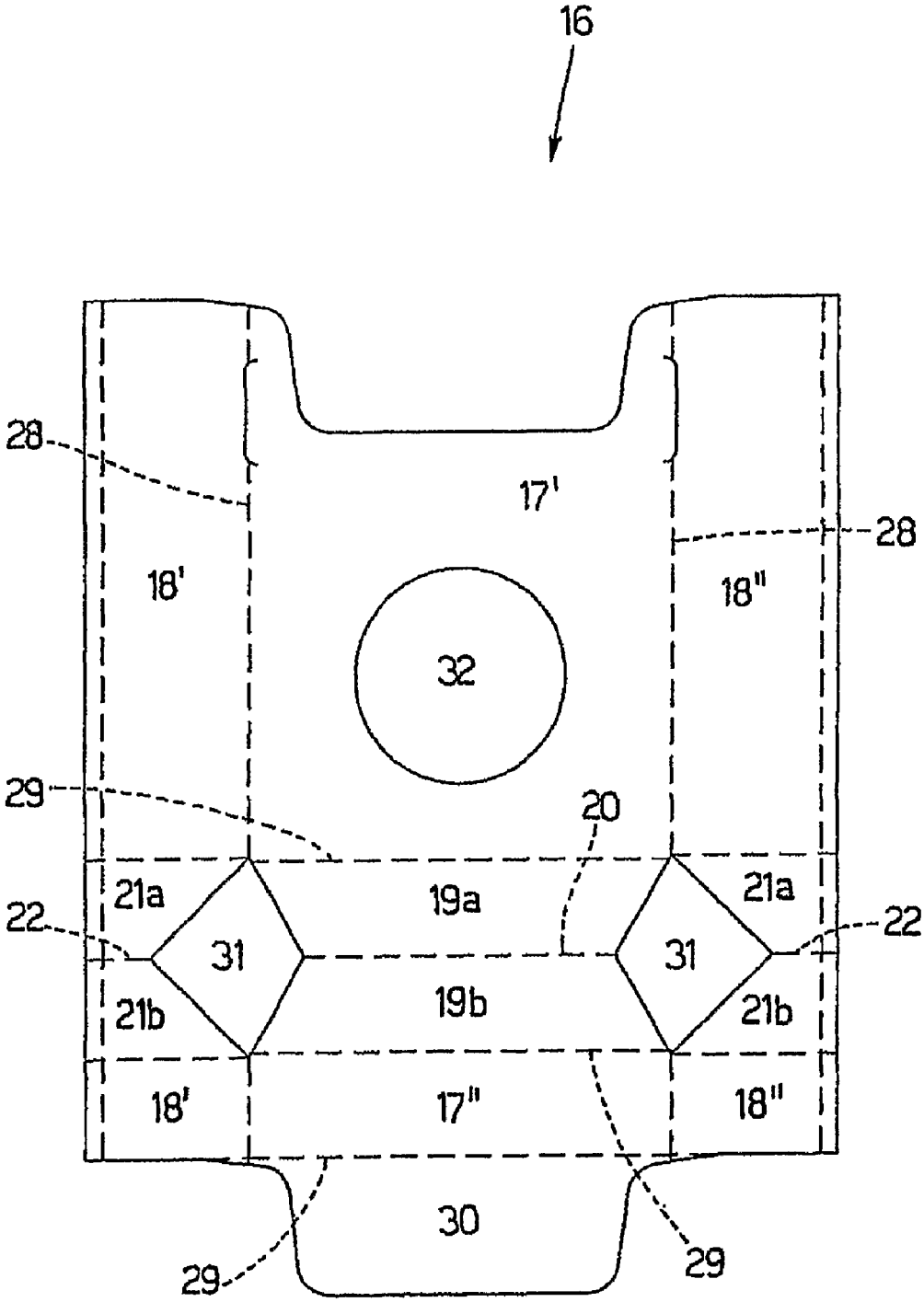
FIG. 6 shows a spread-out view of the FIG. 5 collar.

As shown in FIG. 6, collar 16, spread out, has two longitudinal crease lines 28, and a number of transverse crease lines 29 defining, between the two longitudinal crease lines 28, a panel 17' forming a top portion of front wall 17; panel 19*a* of retaining member 19; panel 19*b* of retaining member 19; a panel 17" forming a bottom portion of front wall 17; and a bottom reinforcing tab 30. Panels 17', 17" each have two lateral wings 18', 18", which are located on opposite sides of panel 17', 17", form lateral walls 18, and are separated from panel 17', 17" by longitudinal crease lines 28. The two panels 21*a* of retaining members 21 are located on opposite sides of panel 19*a* of retaining member 19; and the two panels 21*b* of retaining members 21 are located on opposite sides of panel 19*b* of retaining member 19.

Two rhomboidal holes 31 are formed at the junction between longitudinal crease lines 28 and transverse crease lines 29 on panels 19*a*, 19*b*, 21*a*, and 21*b* of retaining members 19 and 21; and, depending on the shape and size of holes 31, each end of retaining member 19 projecting perpendicularly from front wall 11 may be separated from, tangent to, or superimposed on the corresponding end of retaining member 21.

For example, in the FIGS. 5 and 6 embodiment, each end of retaining member 19 projecting perpendicularly from front wall 11 is enclosed between the ends of the two rigid panels 21*a*, 21*b* defining the corresponding retaining member 21, thus increasing the overall stiffness of retaining members 19 and 21. Whereas, in the FIGS. 7 and 8 embodiment, each end of retaining member 19 projecting perpendicularly from front wall 11 is substantially tangent to the end of corresponding retaining member 21.

Finally, front wall 17 of collar 16 preferably has a normally circular central hole 32 to assist application of collar 16 to group 3 of cigarettes 4 by allowing insertion of a counter-pusher through collar 16 to accompany the movement of group 3 of cigarettes towards collar 16.

In the FIG. 1-6 embodiment, retaining members 19 and 21 therefore form part of collar 16, so that blank 23 forming container 2 is identical to a normal blank for producing an ordinary rigid, hinged-lid packet.

Being identical to a normal blank for producing an ordinary rigid, hinged-lid packet, blank 23 forming container 2 is folded in exactly the same way as a normal blank for producing an ordinary rigid, hinged-lid packet.

To fold collar 16, collar 16 is prefolded along the two transverse crease lines 29 defining panels 19*a*, 19*b*, 21*a* and 21*b*, and along crease lines 20 and 22 before folding collar 16 about group 3 of cigarettes 4. Once collar 16 is prefolded, lateral wings 18' and 18" are normally folded with respect to panels 17' and 17" along the two longitudinal crease lines 28, and panels 19*a* and 21*a* are then folded towards panels 19*b* and 21*b*. Alternatively, panels 19*a* and 21*a* may be folded first towards panels 19*b* and 21*b*, and lateral wings 18' and 18" then folded with respect to panels 17' and 17" along the two longitudinal crease lines 28.

Panels 19*a* and 21*a* are normally folded towards panels 19*b* and 21*b* by pushing panel 17" and possibly also wings 18" towards panel 17' and wings 181. In other words, panels 19*a* and 21*a* are folded towards panels 19*b* and 21*b* by maintaining panel 17' and wings 18' in a fixed position by means of a fixed gripping member, and engaging panel 17" and possibly also wings 18" with a movable gripping member which is then moved towards the fixed gripping member. It should be pointed out that collar 16 is always prefolded before being applied to group 3 of cigarettes 4, whereas folding of collar 16 may be completed before collar 16 is applied to group 3 of cigarettes 4, may be commenced before collar 16 is applied to group 3 of cigarettes 4 and completed after collar 16 is applied to group 3 of cigarettes 4, or may only be commenced after collar 16 is applied to group 3 of cigarettes 4.

In the FIGS. 5 and 6 embodiment, the two rigid panels 19*a*, 19*b*, 21*a*, 21*b* of each retaining member 19, 21 are the same size, and are folded one onto the other so as to be superimposed. The two rigid panels 19*a*, 19*b*, 21*a*, 21*b* of each retaining member 19, 21 are preferably glued to each other. Moreover, each end of retaining member 19 projecting perpendicularly from front wall 11 is enclosed between the ends of the two rigid panels 21*a*, 21*b* defining retaining member 21 projecting perpendicularly from each minor lateral wall 13.

Figure 7:
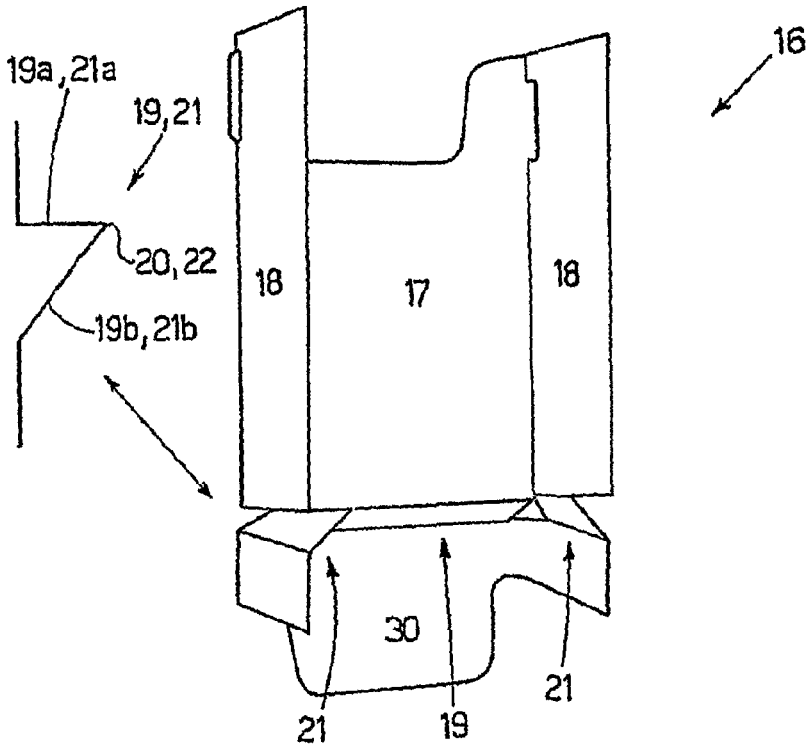
FIG. 7 shows a view in perspective of an alternative embodiment of a collar of the FIG. 1 packet.
Figure 8:
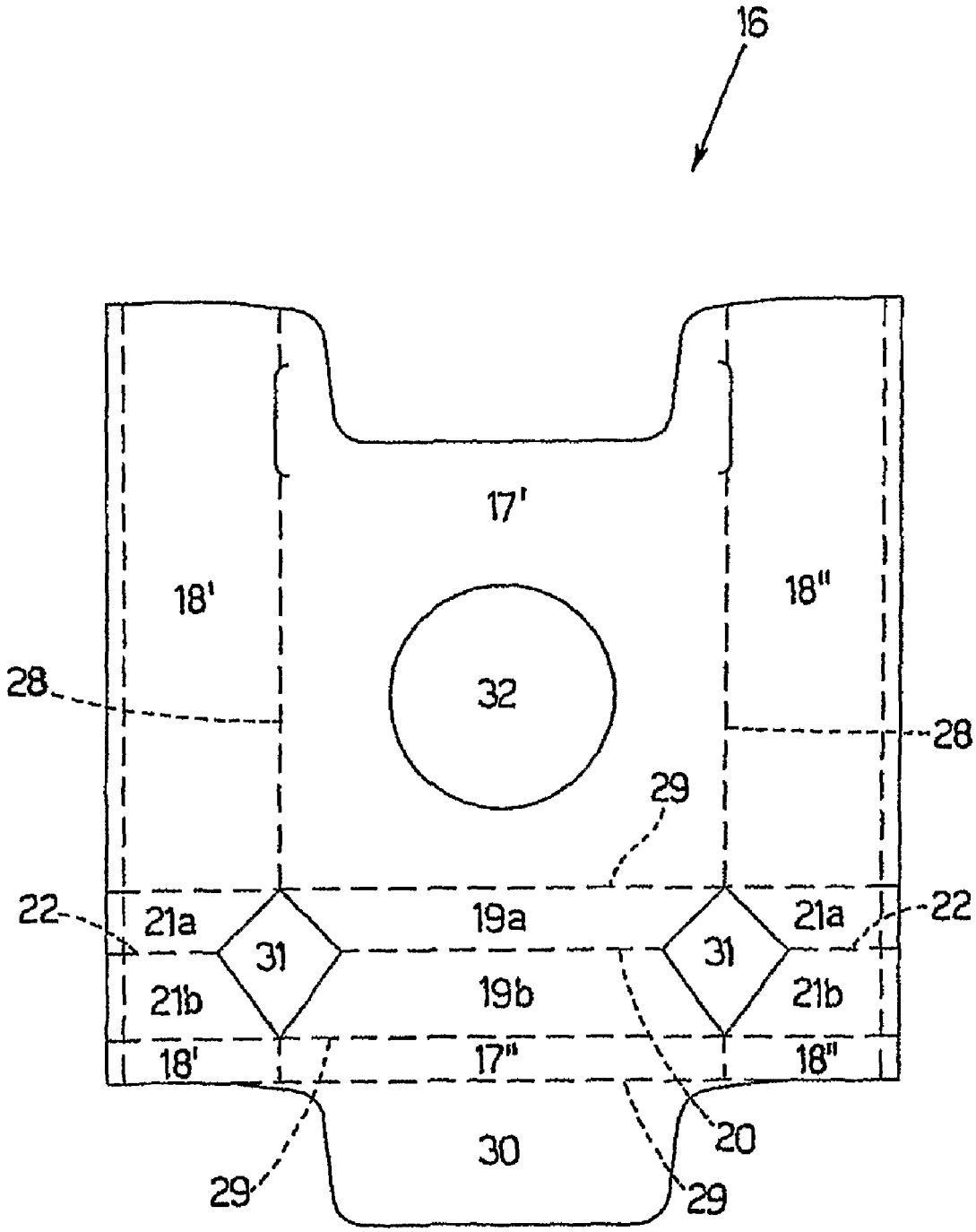
FIG. 8 shows a spread-out view of the FIG. 7 collar.

In the FIGS. 7 and 8 embodiment, the two rigid panels 19*a*, 19*b*, 21*a*, 21*b* of each retaining member 19, 21 are of different sizes and separate; a bottom panel 19*b*, 21*b* is larger, and slopes at an angle of 10 to 45° with respect to the corresponding lateral wall 11, 13; and a top panel 19*a*, 21*a* is smaller and perpendicular to the corresponding lateral wall 11, 13.

In the FIG. 1-8 embodiment, retaining members 19 and 21 define a bottom supporting surface parallel to bottom wall 10 to house inside container 2 a group 3 of cigarettes 4 smaller in height than lateral walls 11, 12 13.

In a different embodiment shown in FIGS. 9-14, retaining members 21 define a lateral supporting surface parallel to minor lateral walls 13 to house inside container 2 a group 3 of cigarettes 4 smaller in width than bottom wall 10.

Figure 9:
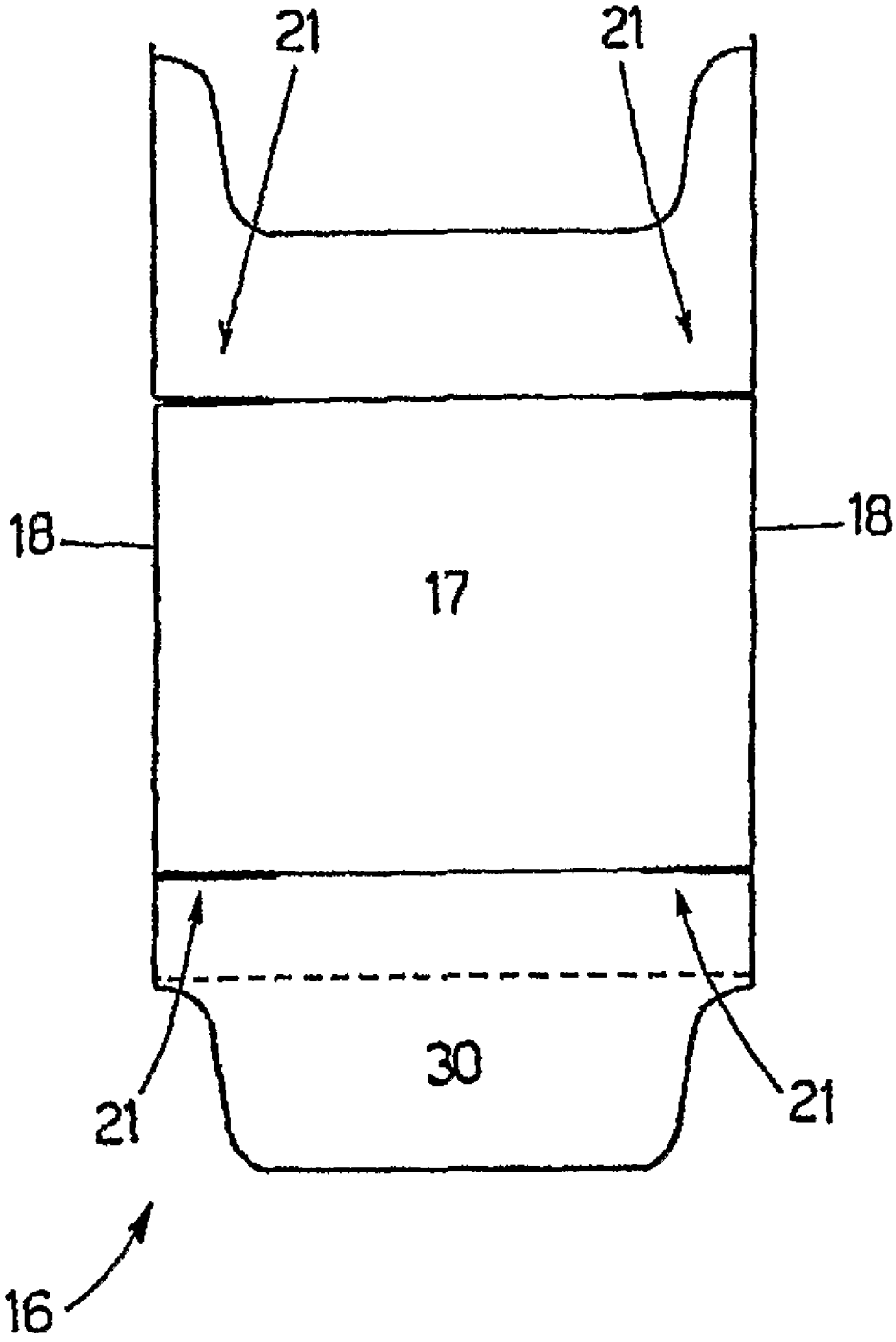
FIG. 9 shows a front view of a different embodiment of a collar of the FIG. 1 packet.
Figure 10:
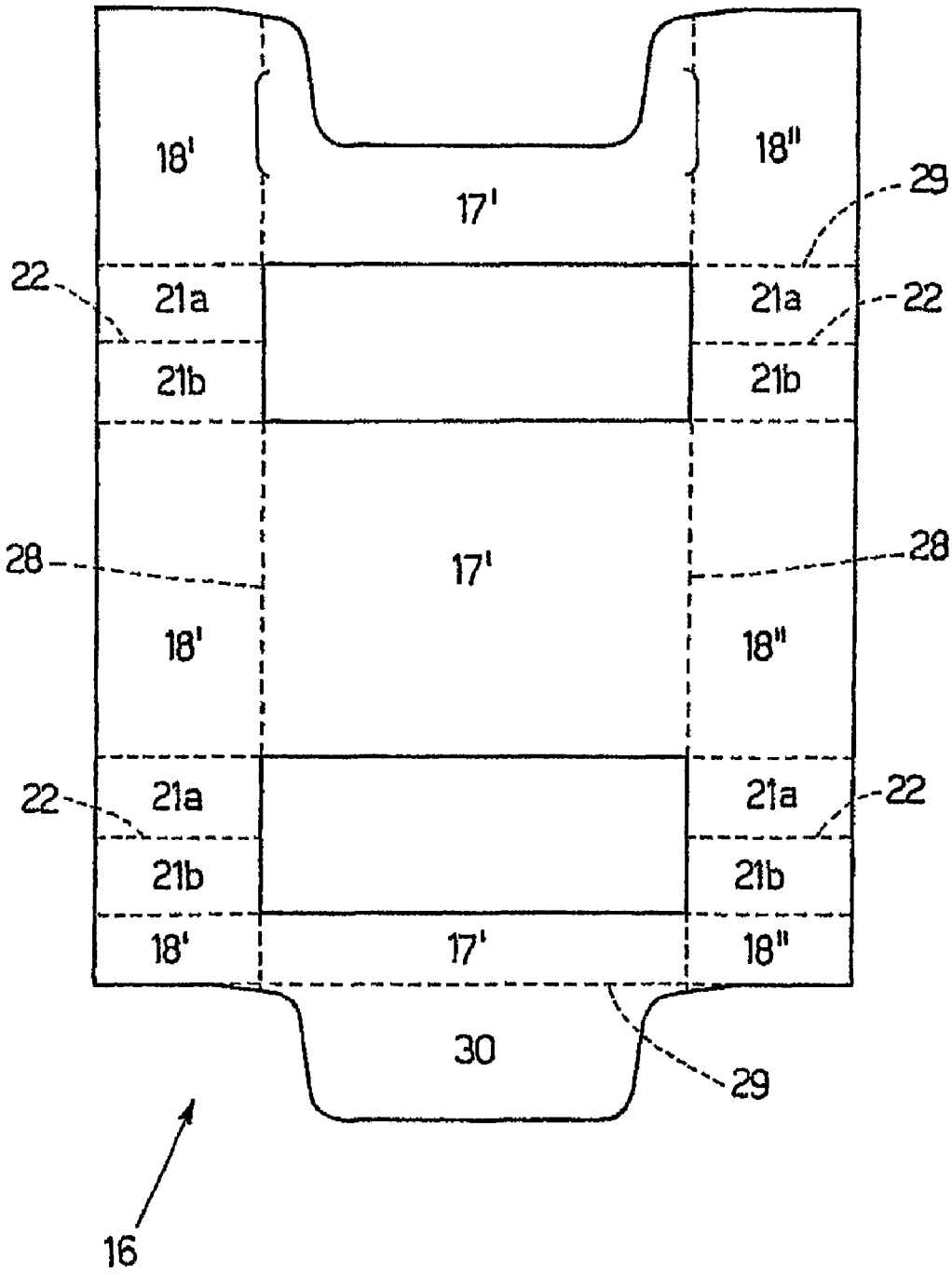
FIG. 10 shows a spread-out view of the FIG. 9 collar.
Figure 11:
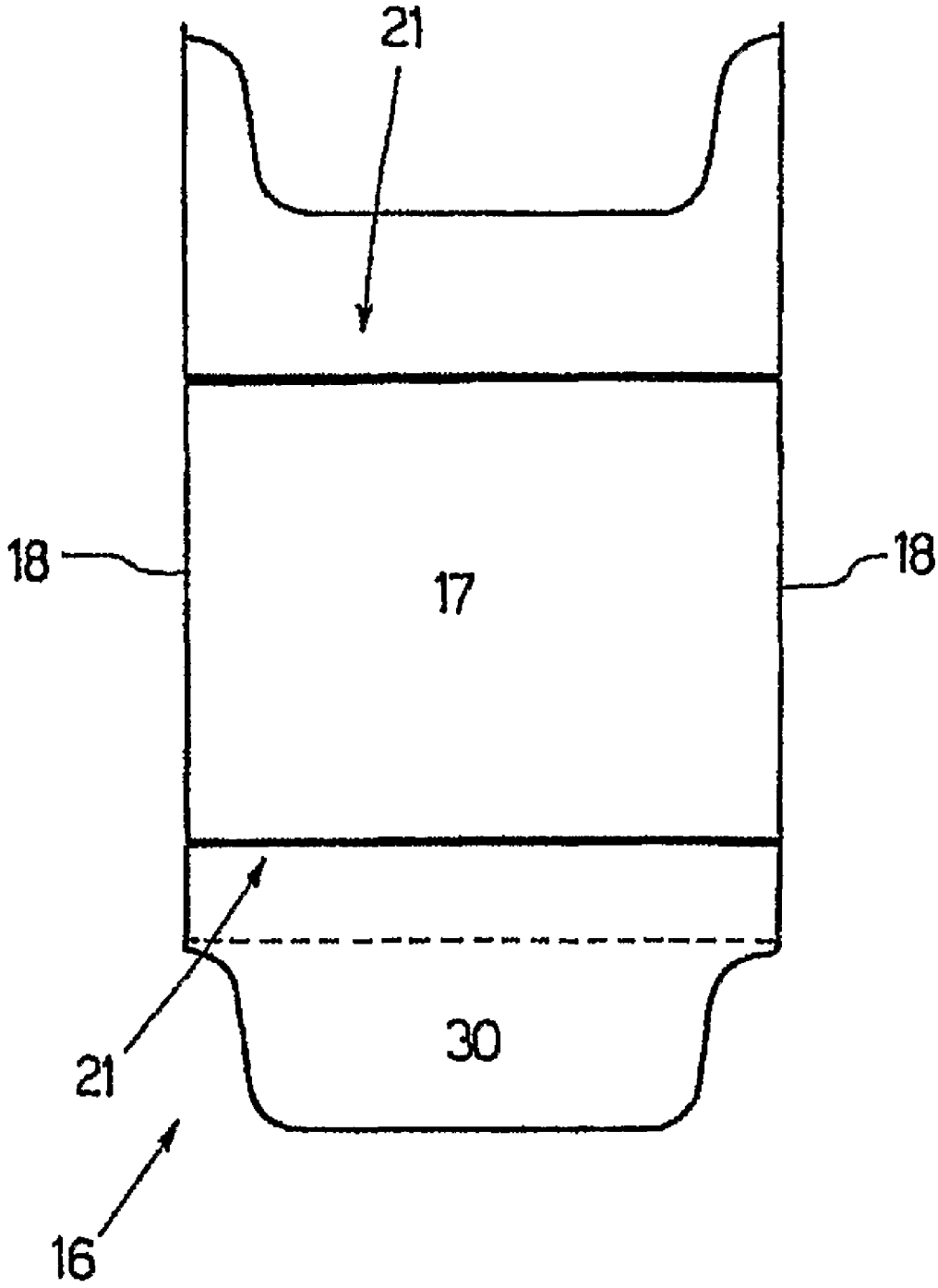
FIG. 11 shows a front view of a further embodiment of a collar of the FIG. 1 packet.
Figure 12:
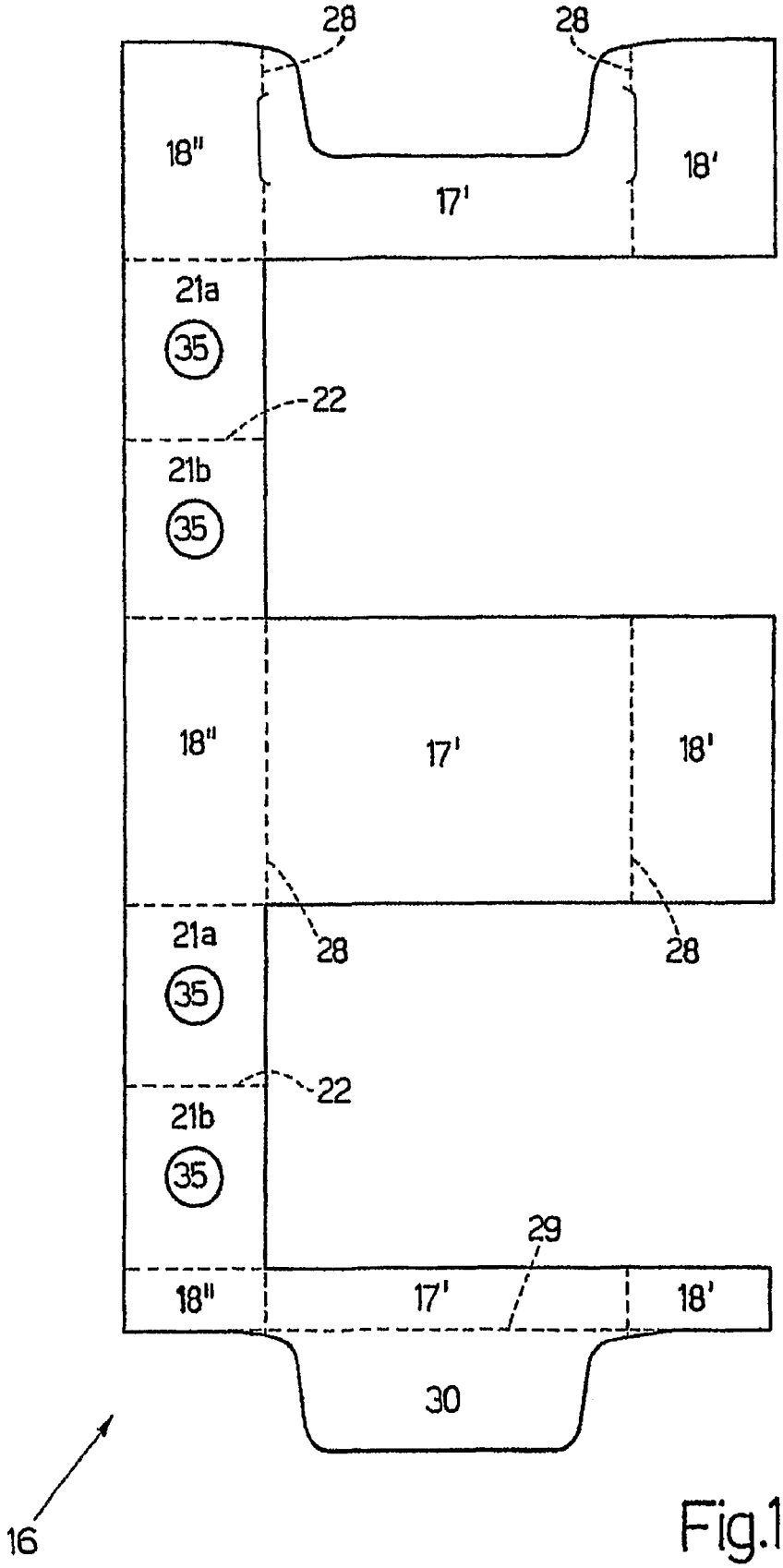
FIG. 12 shows a spread-out view of the FIG. 11 collar.
Figure 13:
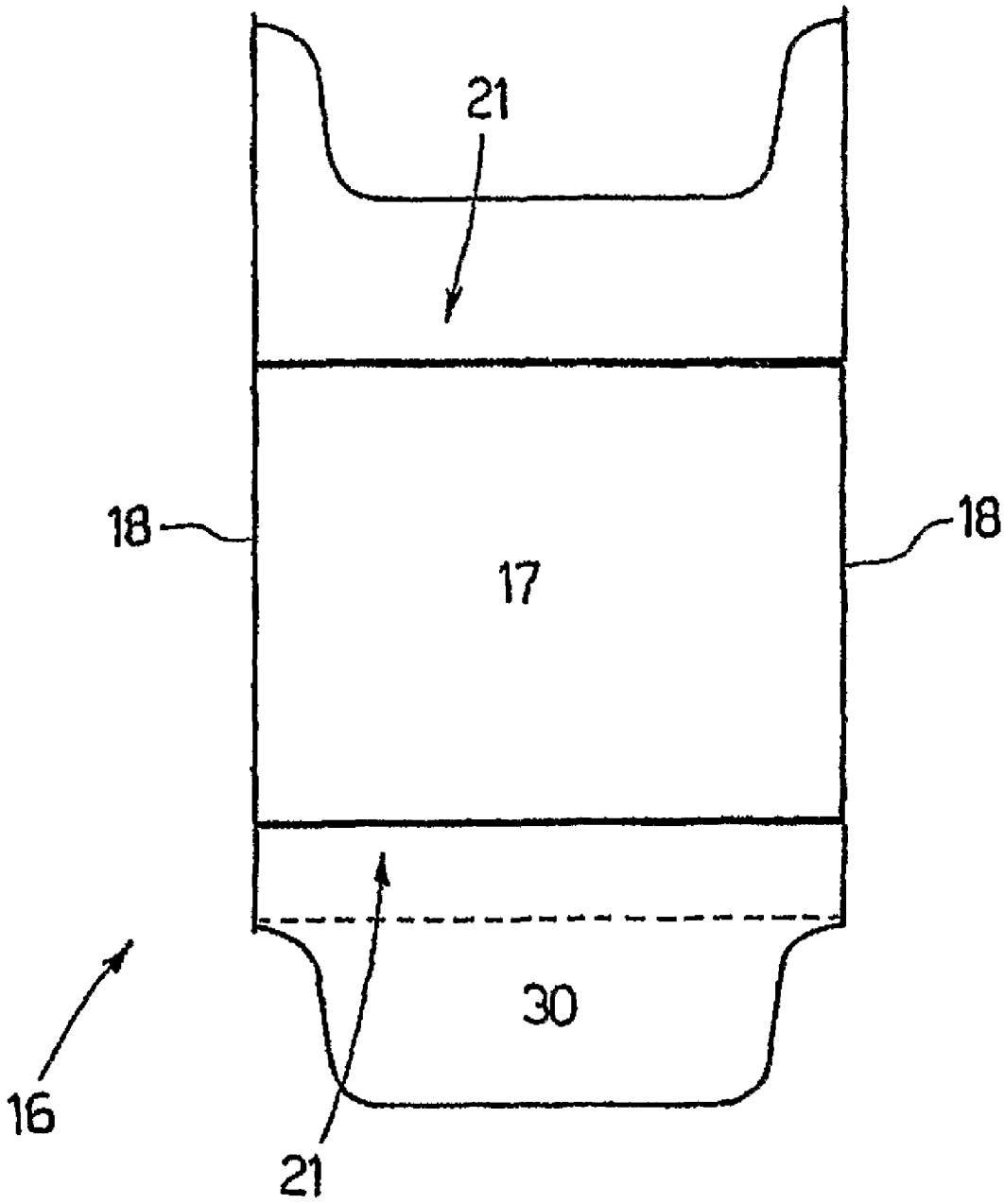
FIG. 13 shows a front view of a further embodiment of a collar of the FIG. 1 packet.
Figure 14:
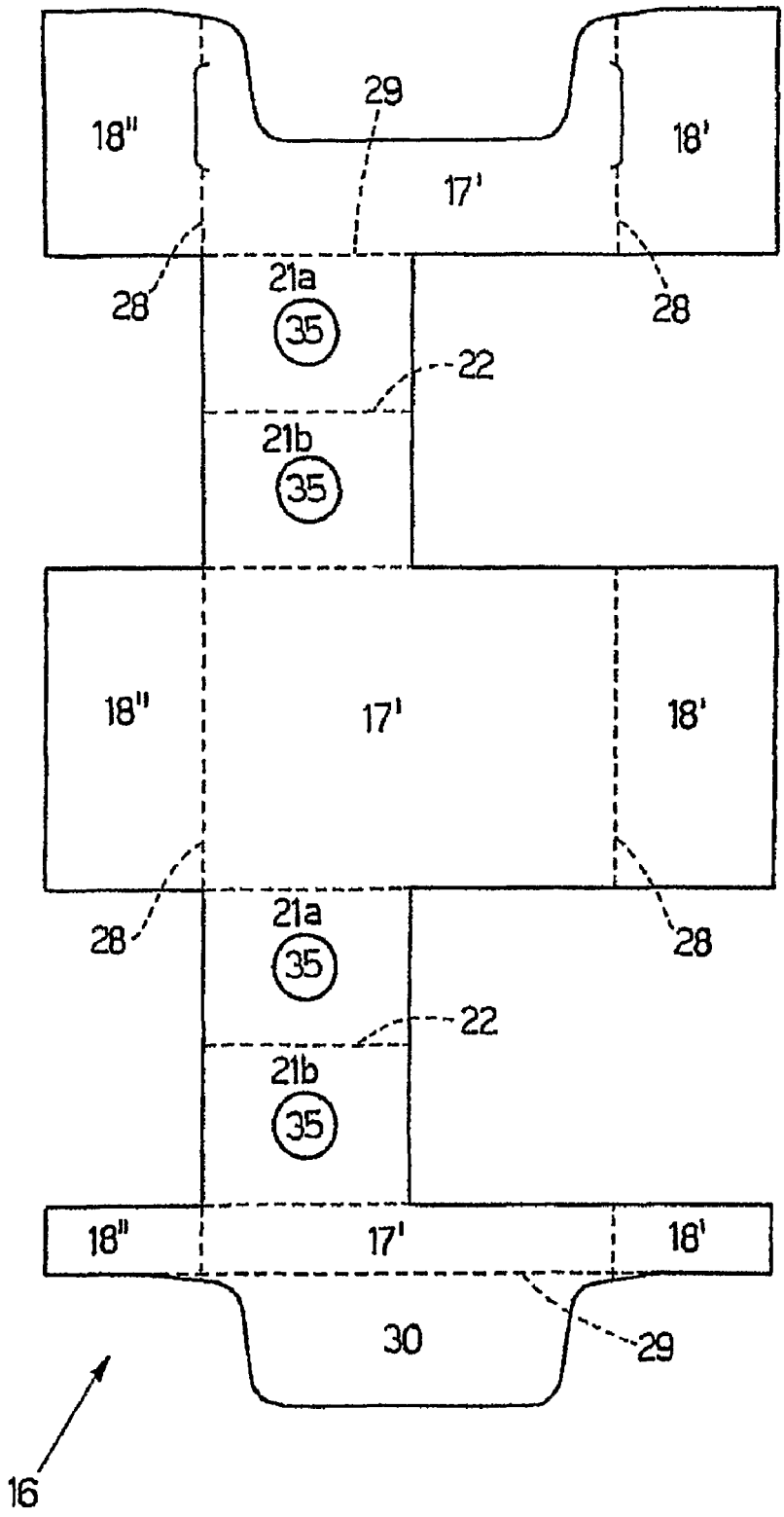
FIG. 14 shows a spread-out view of the FIG. 13 collar.
Figure 17:
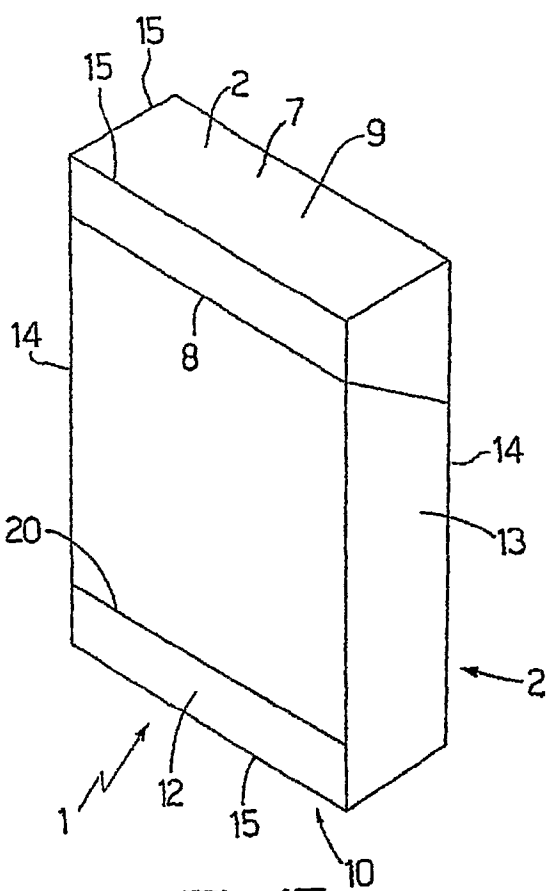
Figure 16:
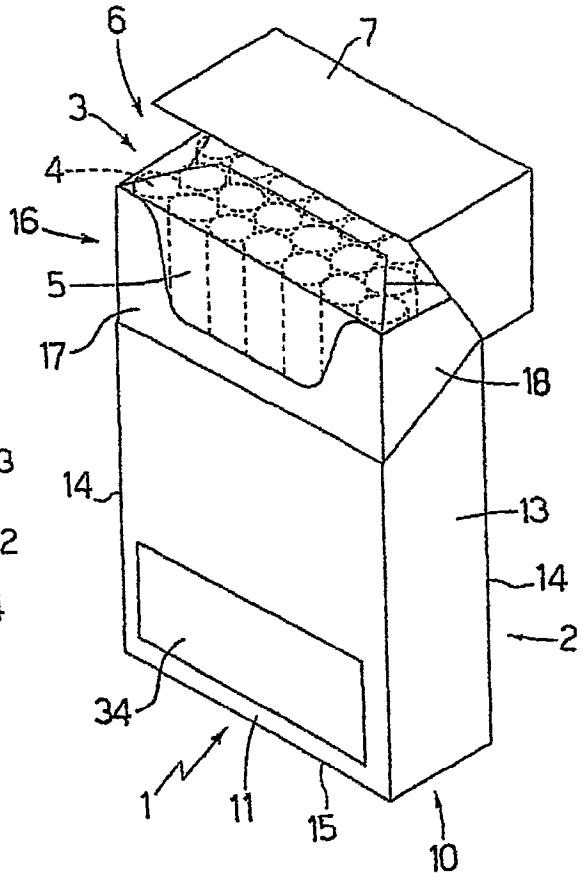
FIG. 16 shows a front view in perspective of the FIG. 15 packet in an open configuration.
Figure 15:
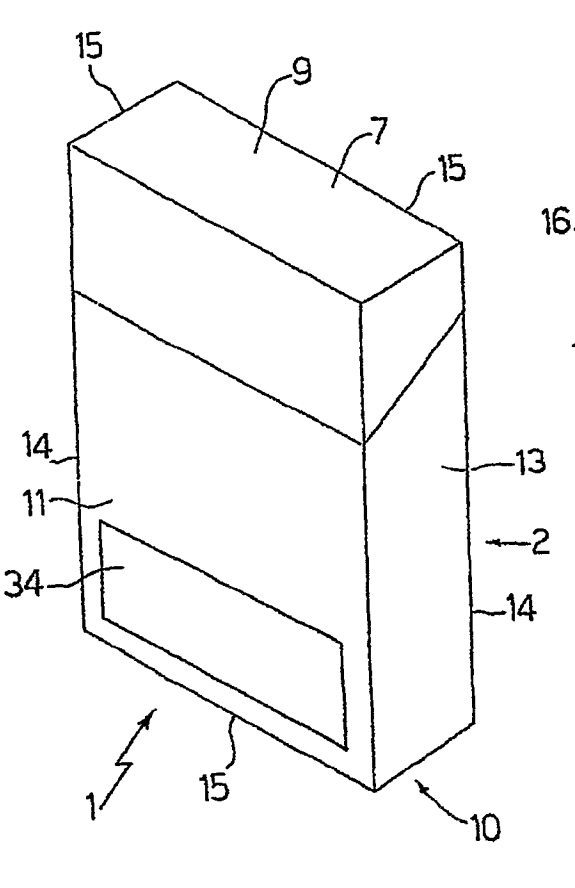
FIG. 15 shows a front view in perspective of a different embodiment of a packet of cigarettes in accordance with the present invention and in a closed configuration.
Figure 18:
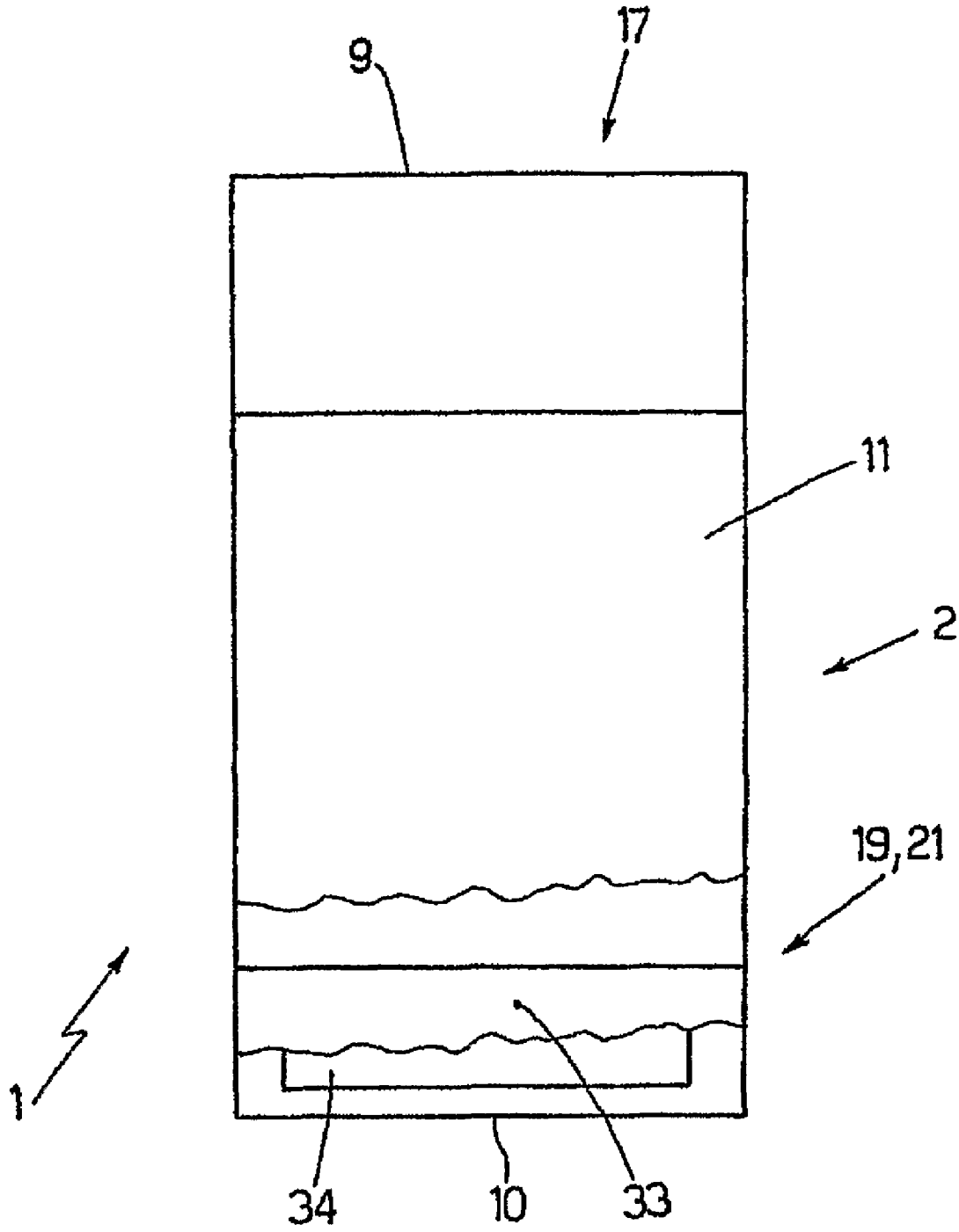
FIG. 18 shows a front view, with parts removed for clarity, of the FIG. 15 packet.

The FIGS. 9 and 10 embodiment has two retaining members 21 projecting from one minor lateral wall 13, and two retaining members 21 projecting from the other minor lateral wall 13; and each retaining member 21 projecting from one minor lateral wall 13 is coplanar with and faces a corresponding retaining member 21 projecting from the other minor lateral wall 13. The FIGS. 11 and 12 embodiment has two parallel, vertically offset retaining members 21, both projecting from the same minor lateral wall 13. FIGS. 13 and 14 show a structural variation of the FIGS. 11 and 12 embodiment, in which two parallel, vertically offset retaining members 21 both project from the same minor lateral wall 13.

A further embodiment, not shown, has two retaining members 21, each of which projects perpendicularly from a respective minor lateral wall 13, and is coplanar with and faces the other retaining member 21.

As will be clear from the foregoing description, in the FIG. 1-14 embodiments, retaining members 19 and 21 form part of collar 16; whereas, in the embodiments described below and shown in FIGS. 15-20, retaining members 19 and 21 form part of container 2 and, hence, blank 23, so that collar 16 is identical to a normal collar for producing an ordinary rigid, hinged-lid packet.

Figure 19:
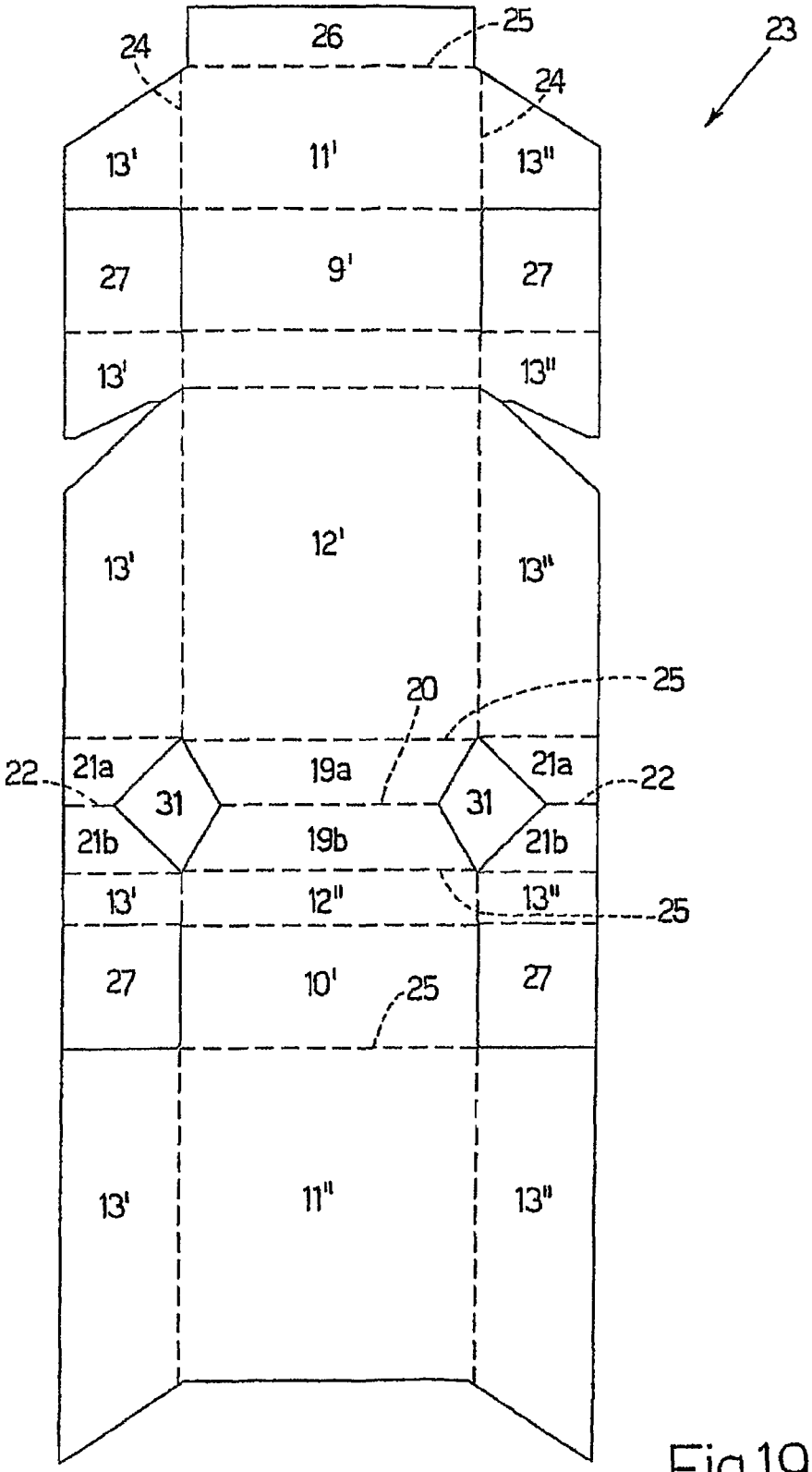
FIG. 19 shows a spread-out view of a blank by which to produce the FIG. 15 packet.
Figure 20:
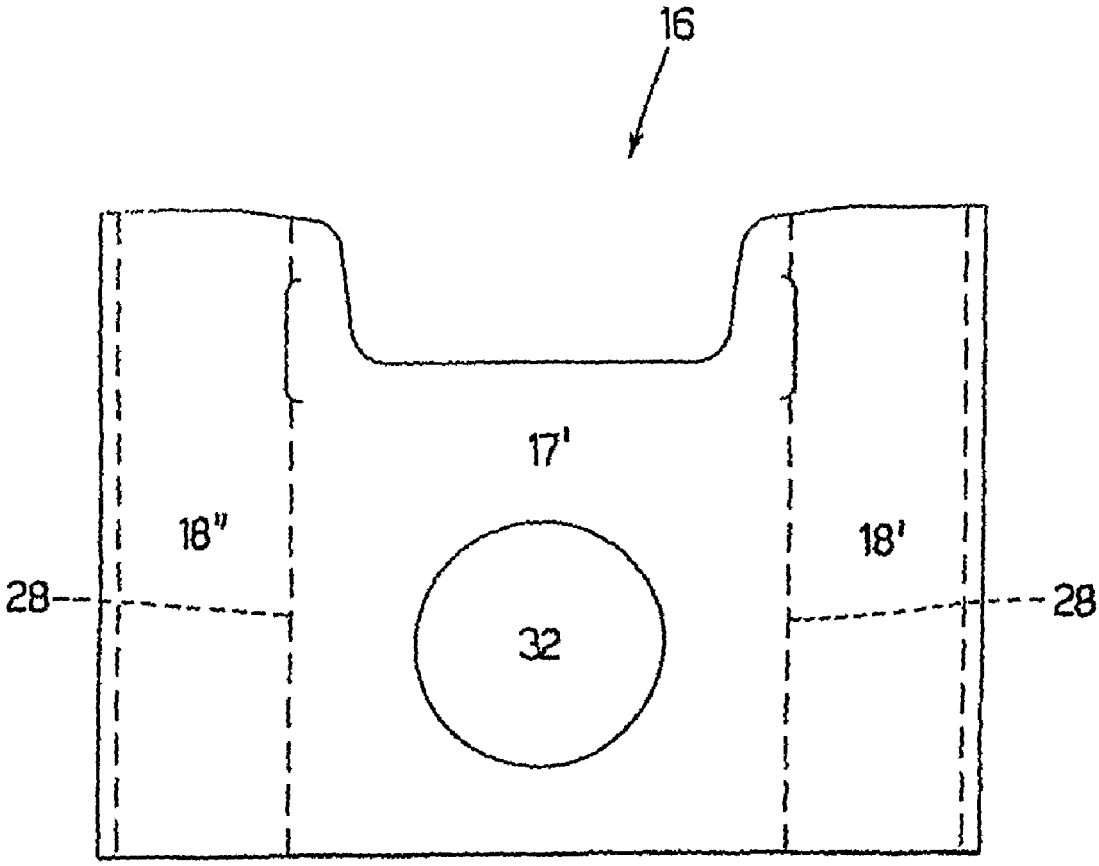
FIG. 20 shows a spread-out view of a collar contained in the FIG. 15 packet.

Blank 23 in FIG. 19 obviously differs from blank 23 in FIG. 4 by comprising panels 19*a*, 19*b*, 21*a* and 21*b* of retaining members 19 and 21.

Being identical to a normal collar for producing an ordinary rigid, hinged-lid packet, collar 16 is folded in exactly the same way as a normal collar for producing an ordinary rigid, hinged-lid packet.

To fold blank 23 forming container 2, blank 23 is prefolded along the two transverse crease lines 25 defining panels 19*a*, 19*b*, 21*a* and 21*b*, and along crease lines 20 and 22 before folding blank 23 about group 3 of cigarettes 4. Once blank 23 is prefolded, wings 13' and 13" are normally folded with respect to panels 12' and 12" along the two longitudinal crease lines 24, and panels 19*a* and 21*a* are then folded towards panels 19*b* and 21*b*. Alternatively, panels 19*a* and 21*a* may be folded first towards panels 19*b* and 21*b*, and lateral wings 13' and 13" then folded with respect to panels 12' and 12" along the two longitudinal crease lines 24.

Panels 19*a* and 21*a* are normally folded towards panels 19*b* and 21*b* by pushing panel 12" and possibly also wings 13" towards panel 12' and wings 131. In other words, panels 19*a* and 21*a* are folded towards panels 19*b* and 21*b* by maintaining panel 12' and wings 13' in a fixed position by means of a fixed gripping member, and engaging panel 12" and possibly also wings 13" with a movable gripping member which is then moved towards the fixed gripping member. It should be pointed out that blank 23 is always prefolded before being applied to group 3 of cigarettes 4, whereas folding of blank 23 may be completed before blank 23 is applied to group 3 of cigarettes 4, may be commenced before blank 23 is applied to group 3 of cigarettes 4 and completed after blank 23 is applied to group 3 of cigarettes 4, or may only be commenced after blank 23 is applied to group 3 of cigarettes 4.

The space 33 (shown in FIG. 18) left inside container 2 by group 3 of cigarettes 4 may be at least partly used to house an accessory (e.g. a lighter) or as a holder or ashtray.

In the embodiments shown in FIGS. 1-8 and 15-20, space 33 is located beneath group 3 of cigarettes 4, and may generally be used as a holder or ashtray; in the FIG. 15-20 embodiment, a hinged door 34 is formed in front wall 11 of container 2 for access to space 33 from the outside.

In the FIG. 9-14 embodiments, space 33 is located alongside group 3 of cigarettes 4, and may generally be used to house an accessory; for which purpose, retaining members 21 may comprise respective coaxial through holes 35 in which to insert the accessory.

In a different embodiment not shown, container 2 is formed by folding a sheet of soft packing material about group 3 of cigarettes 4, and contains a rigid insert similar to collars 16 in FIGS. 5-14 and comprising retaining members 19 and 21. It should be pointed out that the main difference between a collar 16 and the rigid insert lies in the rigid insert not projecting from the open top end 6 of container 2, since there is no lid 7.

In the embodiments shown in the accompanying drawings, edges 14 and 15 are all square edges. In a different embodiment not shown, the four longitudinal edges 14 are non-square rounded or bevelled edges. Alternatively, transverse edges 15 may be non-square rounded or bevelled edges as in the packet of cigarettes described in Patent Application EP-A1-0764595; and both transverse edges 15 and longitudinal edges 14 may be non-square rounded or bevelled edges.

In a different embodiment not shown, each major lateral wall 11, 12 is outwardly convex, is connected to each minor lateral wall 13 along a sharp longitudinal edge 14, and forms an obtuse dihedral angle with each minor lateral wall 13. Each major lateral wall 11, 12 comprises a flat central portion, and two creased lateral bands with longitudinal crease lines; and each lateral band is curved with its concavity facing inwards to connect the central portion to the minor lateral wall 13 and form an obtuse dihedral angle with the minor lateral wall 13. In this case, each wall 9, 10 is substantially rectangular, and has bevelled corners to adapt to the outwardly convex profile of major lateral walls 11 and 12. This embodiment is similar to the packet of cigarettes described in Patent Application EP-A1-1066206, which has outwardly convex front and rear walls, each of which has a flat central portion, and two curved, creased lateral bands connecting the flat central portion to two flat lateral walls of the packet along sharp longitudinal edges.

In a further embodiment not shown, each major lateral wall 11, 12 is outwardly convex, is connected to walls 9 and 10 along sharp transverse edges 15, and forms an obtuse dihedral angle with each wall 9, 10. More specifically, each major lateral wall 11, 12 comprises a flat central portion, and a creased lateral band with transverse crease lines; and the lateral band is curved with its concavity facing inwards to connect the central portion to wall 9, 10 and form an obtuse dihedral angle with wall 9, 10. In this case, each minor lateral wall 13 is substantially rectangular, and has bevelled corners to adapt to the outwardly convex profile of major lateral walls 11 and 12. This embodiment is similar to the packet of cigarettes described in Patent Application IT-B02001A000584, which has outwardly convex front and rear walls, each of which has a flat central portion, and two curved, creased lateral bands connecting the flat central portion to two flat walls of the packet along sharp transverse edges.

Clearly, changes may be made to packets 1 as described above, such as replacing the convex walls with partly convex walls, or forming only one convex wall as opposed to two opposite, facing, convex walls.

Packet 1 of cigarettes as described above has numerous advantages, by housing a small group 3 of cigarettes 4, while at the same time being cheap and easy to produce, by involving only minor alterations to collar 16 or blank 23, and by enabling folding of collar 16 or blank 23 on an only slightly modified standard packing machine.

In view of the numerous advantages of packet 1 of cigarettes as described above, the form of packet 1 may also be applied integrally to the manufacture of a carton (rigid or soft) of cigarettes, which is substantially identical to packet 1 described, the only difference being that it contains a group of packets of cigarettes as opposed to a group of cigarettes.

The invention claimed is:

1. A package for tobacco articles, comprising:

a group (3) of tobacco articles (4);

a cup-shaped container (2) housing the group (3) of tobacco articles (4), having an open top end (6), a bottom wall (10), two parallel, opposite major lateral walls (11, 12), and two parallel, opposite minor lateral walls (13), and having a cup-shaped lid (7) hinged to the container (2) along a hinge (8) to rotate, with respect to the container (2), between an open position and a closed position opening and closing the open top end (6) respectively;

a rigid collar (16), which is folded at least into a "U", is connected to the inside of the container (2), projects partly outwards of the open top end (6) to engage a corresponding inner surface of the lid (7) when the lid (7) is in said closed position, and comprises a front wall (17) and two lateral walls (18) on opposite sides of the front wall (17); and at least one retaining member (19; 21), which is located inside the container (2), projects perpendicularly from at least one of the lateral walls (11; 12; 13), defines a supporting surface for the group (3) of tobacco articles (4), and is defined by two rigid panels (19*a*, 19*b*; 21*a*, 21*b*) separated from each other by a crease line (20; 22) and folded one towards the other;

wherein the two rigid panels (19*a*, 19*b*; 21*a*, 21*b*) of the at least one retaining member (19; 21) form part of the collar (16), are the same size, and are folded one onto the other so as to be superimposed.

2. A package as claimed in claim 1, wherein the two rigid panels (19*a*, 19*b*; 21*a*, 21*b*) of the at least one retaining member (19; 21) are glued to each other.

3. A package as claimed in claim 1, wherein the at least one retaining member (19; 21) defines a bottom supporting surface parallel to the bottom wall (10) to house inside the container (2) a group (3) of tobacco articles (4) smaller in height than the lateral walls (11, 12, 13).

4. A package as claimed in claim 3, wherein three retaining members (19; 21) project perpendicularly from the two minor lateral walls (13) and from one major lateral wall (11; 12).

5. A package as claimed in claim 4, wherein each end of the at least one retaining member (19) projecting perpendicularly from the major lateral wall (11; 12) is enclosed between the ends of the two rigid panels (21*a*, 21*b*) defining a retaining member (21) projecting perpendicularly from a minor lateral wall (13).

6. A package as claimed in claim 1, wherein the at least one retaining member (19; 21) defines a lateral supporting surface parallel to the minor lateral walls (13) to house inside the container (2) a group (3) of tobacco articles (4) smaller in width than the bottom wall (10).

7. A package as claimed in claim 6, and comprising two retaining members (21), each of which projects perpendicularly from a respective minor lateral wall (13) and is coplanar with and faces an other retaining member (19; 21).

8. A package as claimed in claim 1, wherein the collar (16), when flat, has two longitudinal crease lines (28), and a number of transverse crease lines (29) defining, between the two longitudinal crease lines (28), a first panel (17') forming a top portion of the front wall (17); a second panel (19*a*) of the at least one retaining member (19); a third panel (19*b*) of the at least one retaining member (19); and a fourth panel (17") forming a bottom portion of the front wall (17); the first and fourth panel (17', 17") each have two lateral wings (18', 18"), which are located on opposite sides of the first and fourth panel (17', 17"), form the lateral walls (18), and are separated from the first and fourth panel (17', 17") by the longitudinal crease lines (28).

9. A package as claimed in claim 8, wherein three retaining members (19; 21) project perpendicularly from the two minor lateral walls (13) and from a major lateral wall (11; 12); two fifth panels (21*a*) of the retaining members (21) projecting from the two minor lateral walls (13) are located on opposite sides of the second panel (19*a*) of the retaining member (19) projecting from a major lateral wall (11; 12), and are separated from the second panel (19*a*) by the longitudinal crease lines (28); and two sixth panels (21*b*) of the retaining members (21) projecting from the two minor lateral walls (13) are located on opposite sides of the third panel (19*b*) of the retaining member (19) projecting from a major lateral wall (11; 12), and are separated from the third panel (19*b*) by the longitudinal crease lines (28).

10. A package as claimed in claim 9, wherein two rhomboidal holes (31) are formed at the junction between the longitudinal crease lines (28) and the transverse crease lines (29) on the second, third, fifth, and sixth panel (19*a*, 19*b*, 21*a*, 21*b*) of the retaining members (19, 21).

11. A package as claimed in claim 1, wherein the front wall (17) of the collar (16) has a central hole (32).

12. A package for tobacco articles, comprising:

a group (3) of tobacco articles (4);

a cup-shaped container (2) housing the group (3) of tobacco articles (4), having an open top end (6), a bottom wall (10), two parallel, opposite major lateral walls (11, 12), and two parallel, opposite minor lateral walls (13), and having a cup-shaped lid (7) hinged to the container (2) along a hinge (8) to rotate, with respect to the container (2), between an open position and a closed position opening and closing the open top end (6) respectively;

a rigid collar (16), which is folded at least into a "U", is connected to the inside of the container (2), projects partly outwards of the open top end (6) to engage a corresponding inner surface of the lid (7) when the lid (7) is in said closed position, and comprises a front wall (17) and two lateral walls (18) on opposite sides of the front wall (17); and at least one retaining member (19; 21), which is located inside the container (2), projects perpendicularly from at least one of the lateral walls (11; 12; 13), defines a bottom supporting surface for the group (3) of tobacco articles (4) parallel to the bottom wall (10) to house inside the container (2) a group (3) of tobacco articles (4) smaller in height than the lateral walls (11, 12, 13), and is defined by two rigid panels (19*a*, 19*b*; 21*a*, 21*b*) separated from each other by a crease line (20; 22), folded one towards the other and forming part of the collar (16);

wherein three retaining members (19; 21) project perpendicularly from the two minor lateral walls (13) and from one major lateral wall (11; 12).

13. A package as claimed in claim 12, wherein the two rigid panels (19*a*, 19*b*; 21*a*, 21*b*) of each retaining member (19; 21) are the same size, and are folded one onto the other so as to be superimposed; each end of the retaining member (19) projecting perpendicularly from the major lateral wall (11; 12) is enclosed between the ends of the two rigid panels (21*a*, 21*b*) defining a retaining member (21) projecting perpendicularly from a minor lateral wall (13).

14. A package for tobacco articles, comprising:

a group (3) of tobacco articles (4);

a cup-shaped container (2) housing the group (3) of tobacco articles (4), having an open top end (6), a bottom wall (10), two parallel, opposite major lateral walls (11, 12), and two parallel, opposite minor lateral walls (13), and having a cup-shaped lid (7) hinged to the container (2) along a hinge (8) to rotate, with respect to the container (2), between an open position and a closed position opening and closing the open top end (6) respectively;

a rigid collar (16), which is folded at least into a "U", is connected to the inside of the container (2), projects partly outwards of the open top end (6) to engage a corresponding inner surface of the lid (7) when the lid (7) is in said closed position, and comprises a front wall (17) and two lateral walls (18) on opposite sides of the front wall (17); and at least one retaining member (19; 21), which is located inside the container (2), projects perpendicularly from at least one of the lateral walls (11; 12; 13), defines a supporting surface for the group (3) of tobacco articles (4), and is defined by two rigid panels (19*a*, 19*b*; 21*a*, 21*b*) separated from each other by a crease line (20; 22), folded one towards the other and forming form part of the collar (16);

wherein the collar (16), when flat, has two longitudinal crease lines (28), and a number of transverse crease lines (29) defining, between the two longitudinal crease lines (28), a first panel (17') forming a top portion of the front wall (17); a second panel (19*a*) of the at least one retaining member (19); a third panel (19*b*) of the at least one retaining member (19); and a fourth panel (17") forming a bottom portion of the front wall (17); and wherein the first and fourth panel (17', 17") each have two lateral wings (18', 18"), which are located on opposite sides of the first and fourth panel (17', 17"), form the lateral walls (18), and are separated from the first and fourth panel (17', 17") by the longitudinal crease lines (28).

15. A package as claimed in claim 14, wherein three retaining members (19; 21) project perpendicularly from the two minor lateral walls (13) and from a major lateral wall (11; 12); two fifth panels (21*a*) of the retaining members (21) projecting from the two minor lateral walls (13) are located on opposite sides of the second panel (19*a*) of the retaining member (19) projecting from a major lateral wall (11; 12), and are separated from the second panel (19*a*) by the longitudinal crease lines (28); and two sixth panels (21*b*) of the retaining members (21) projecting from the two minor lateral walls (13) are located on opposite sides of the third panel (19*b*) of the retaining member (19) projecting from a major lateral wall (11; 12), and are separated from the third panel (19*b*) by the longitudinal crease lines (28).

16. A package as claimed in claim 15, wherein two rhomboidal holes (31) are formed at the junction between the longitudinal crease lines (28) and the transverse crease lines (29) on the second, third, fifth, and sixth panel (19*a*, 19*b*, 21*a*, 21*b*) of the retaining members (19, 21).

17. A package for tobacco articles, comprising:

a group (3) of tobacco articles (4);

a cup-shaped container (2) housing the group (3) of tobacco articles (4), having an open top end (6), a bottom wall (10), two parallel, opposite major lateral walls (11, 12), and two parallel, opposite minor lateral walls (13), and having a cup-shaped lid (7) hinged to the container (2) along a hinge (8) to rotate, with respect to the container (2), between an open position and a closed position opening and closing the open top end (6) respectively;

a rigid collar (16), which is folded at least into a "U", is connected to the inside of the container (2), projects partly outwards of the open top end (6) to engage a corresponding inner surface of the lid (7) when the lid (7) is in said closed position, and comprises a front wall (17) and two lateral walls (18) on opposite sides of the front wall (17); and at least one retaining member (19; 21), which is located inside the container (2), projects perpendicularly from at least one of the lateral walls (11; 12; 13), defines a bottom supporting surface parallel to the bottom wall (10) for the group (3) of tobacco articles (4), and is defined by two rigid panels (19*a*, 19*b*; 21*a*, 21*b*) separated from each other by a crease line (20; 22), folded one towards the other and forming part of the collar (16);

wherein the group (3) of tobacco articles (4) is smaller in height than the lateral walls (11, 12, 13) of the cup-shaped container (2) and rests on the bottom supporting surface defined by the at least one retaining member (19; 21) to define a free space (33) between the bottom supporting surface defined by the at least one retaining member (19; 21) and the bottom wall (10) of the cup-shaped container (2).

* * * * *